US006409099B1

(12) United States Patent
Goodwin et al.

(10) Patent No.: US 6,409,099 B1
(45) Date of Patent: Jun. 25, 2002

(54) FAUCET COVER AND DISPENSER

(76) Inventors: Sean K. Goodwin; Janis R. Goodwin, both of 643 Sea Pine Cir., Pensacola, FL (US) 32506

( * ) Notice: Subject to any disclaimer, the term of this patent is extended or adjusted under 35 U.S.C. 154(b) by 0 days.

(21) Appl. No.: 09/696,954

(22) Filed: Oct. 27, 2000

Related U.S. Application Data

(63) Continuation-in-part of application No. 09/459,690, filed on Dec. 13, 1999, now abandoned.

(51) Int. Cl.[7] ..... A02C 5/02; B05B 7/26; B05B 7/28

(52) U.S. Cl. ..... 239/310; 239/315; 239/316

(58) Field of Search ..... 239/310, 302, 239/314, 315, 316, 350, 418, 434.5, 211, 288–0.5, 289, 379, 423, 424, 308; 222/478, 481, 482, 566; 4/678; 137/375; 210/460, 424

(56) References Cited

U.S. PATENT DOCUMENTS 2,647,797 A * 8/1953 Moss ..... 239/315
2,705,091 A * 3/1955 Marchand ..... 239/315
3,079,093 A * 2/1963 Bellows ..... 239/315
3,140,829 A * 7/1964 Rose ..... 239/315
3,174,691 A * 3/1965 Haviland ..... 239/315
3,409,230 A * 11/1968 Eelkema ..... 239/315
3,623,638 A * 11/1971 Henning ..... 239/315
3,780,869 A * 12/1973 Krongos ..... 210/317
4,711,718 A * 12/1987 Nelson, Jr. ..... 210/282
4,824,565 A * 4/1989 Middleton ..... 210/266
5,125,577 A * 6/1992 Frankel ..... 239/211
5,510,031 A * 4/1996 Knauf, Jr. et al. ..... 210/460

FOREIGN PATENT DOCUMENTS

AT 207770 * 2/1960 ..... 239/315

* cited by examiner

*Primary Examiner*—Henry C. Yuen
*Assistant Examiner*—Davis Hwu
(74) *Attorney, Agent, or Firm*—Stephen R. Greiner

(57) ABSTRACT

A faucet cover and dispenser including a resilient body for positioning over the end of a faucet. The resilient body has an internal, liquid reservoir and a faucet-receiving chamber adjacent the liquid reservoir. The faucet-receiving chamber ends at openings in the rear and bottom of the resilient body. The top of the resilient body is provided with a liquid inlet opening in fluid communication with the liquid reservoir. The bottom of the resilient body is provided with a liquid outlet opening in fluid communication with the liquid reservoir.

18 Claims, 1 Drawing Sheet

10
12
18
28
30
32
35
38
40
57
61

20
22
24
26
27
34
36
42
44
45
46
48
50
55
59
63
65

FAUCET COVER AND DISPENSER

This application is a continuation-in-part of the application, Ser. No. 09/459,690, filed Dec. 13, 1999, now abandoned.

FIELD OF THE INVENTION

The present invention relates generally to fluid sprinkling, spraying and diffusing devices and, more particularly, to supply holders for material to be mixed in a flowing liquid stream beyond the liquid stream outlet.

BACKGROUND OF THE INVENTION

Liquid dispensers adapted for attachment to faucets for adding soap or cologne to bath water have long been known. These dispensers have typically employed cumbersome mounting brackets, rigid parts and reservoirs not easily closed to prevent loss of liquid thereby making such undesirable for use, especially in locations where children are present. A need, therefore, exists for a dispenser that is safe to use, simple to install and will not waste the liquid soap, cologne, etc., being dispensed.

SUMMARY OF THE INVENTION

In light of the problems associated with the known liquid dispensers for attachment to faucets, it is a principal object of the invention to provide a dispenser featuring a soft, liquid-filled body adapted for positioning over the free end of a faucet that will selectively dispense liquid into water emitted by the faucet. The liquid-filled body is mounted upon the faucet with neither special tools nor training and serves as cushion in the event that a user falls against the faucet.

Still another object of the invention is to provide a faucet cover and dispenser of the type described which might be refilled as often as desired with any liquid soap, bath oil or cologne for reuse and might be positioned upon faucets of numerous makes and models without resort to tools or a prolonged period of instruction.

It is an object of the invention to provide improved elements and arrangements thereof in a faucet cover and dispenser for the purposes described which is lightweight in construction, inexpensive to manufacture, and dependable in use.

Briefly, the faucet cover and dispenser in accordance with this invention achieves the intended objects by featuring a resilient body formed of rubber and having a pair of. opposed side portions connected by a top portion and a front portion. The side, top and front portions are hollow and are in fluid communication with one another so as to form a liquid reservoir therein. The side, top and front portions are also oriented to define a faucet-receiving chamber surrounded by the reservoir. An inlet opening in the top portion permits the reservoir to be filled and an outlet opening in the front portion permits the reservoir to be drained.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figures 1, 2, 3, 4:
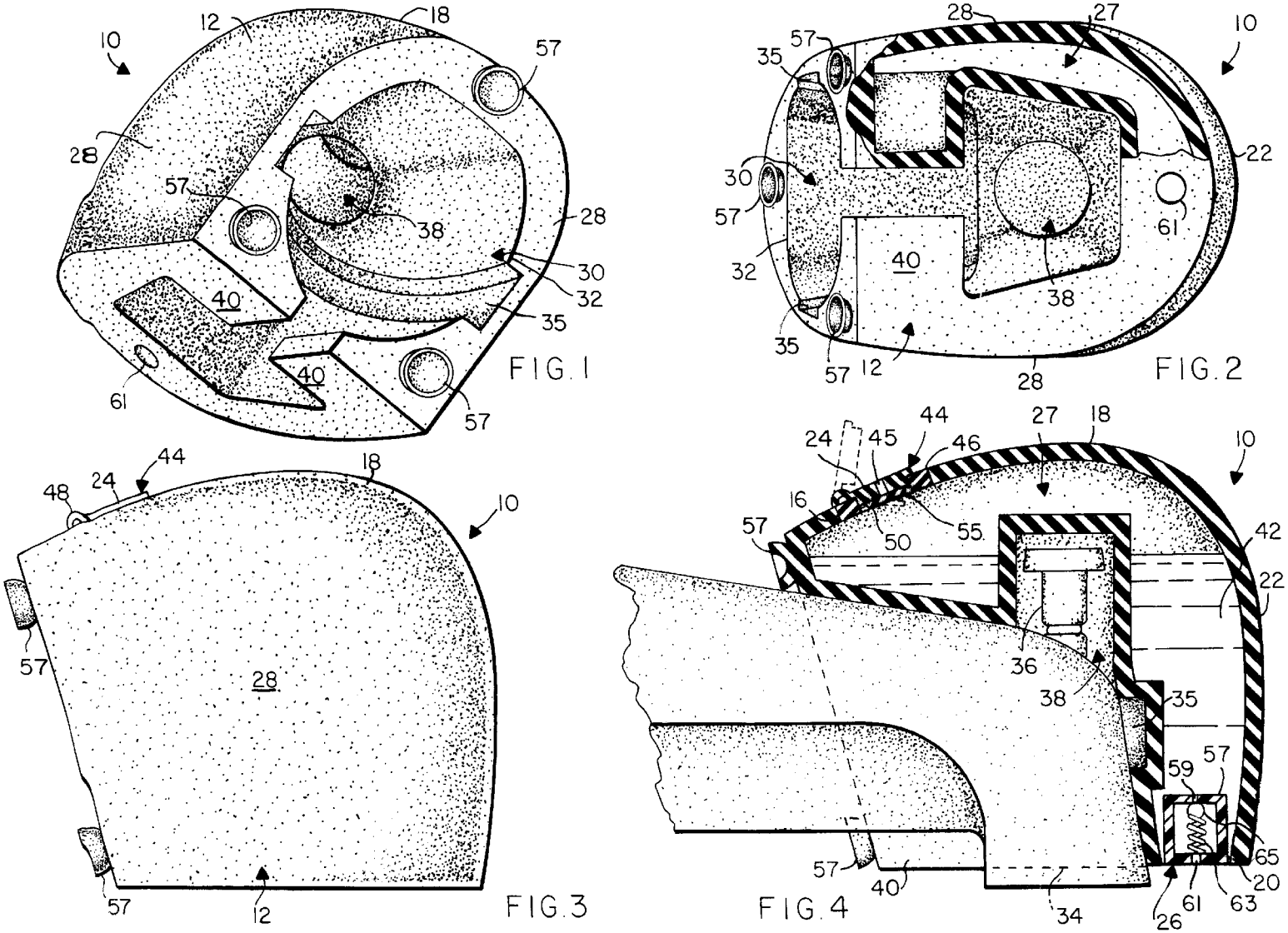
FIG. 1 is a perspective view of a faucet cover and dispenser in accordance with the present invention.
FIG. 2 is a bottom view of the faucet cover and dispenser of FIG. 1 with portions broken away to reveal details thereof.
FIG. 3 is a side view of the faucet cover and dispenser.
FIG. 4 is a cross-sectional view of the faucet cover and dispenser shown positioned on a faucet.

Referring now to the FIGS., a faucet cover and dispenser in accordance with the present invention is shown at 10. Faucet cover and dispenser 10 includes a resilient body 12 for positioning over the end of a faucet 14 and having an inlet opening 16 in its top and an outlet opening 20 in its bottom. A cap 24 permits the entry of a liquid 42 into resilient body 12 whereas a valve 26 controls the exit of liquid 42 from opening 20.

Body 12 has a pair of opposed side portions 28 fastened together at their upper ends by top portion 18 and at their front ends by a front portion 22. Portions 18, 22 and 28 are hollow and, together, define a liquid reservoir 27 for holding liquid 42. The inner surfaces of portions 18, 22 and 28 define a faucet-receiving chamber 30 that terminates at openings 32 and 34 in the rear and bottom of body 12. To accommodate a valve plunger 36 extending upwardly from the front end of faucet 14, a cylindrical recess 38 is provided in the inner surface of top portion 18. To accommodate some faucet shapes, a groove 35, positioned beneath recess 38 and parallel to the bottom of body 12, is provided in the inner surfaces of front and side portions 22 and 28.

To better fasten body 12 to faucet 14, a pair of inwardly directed flanges 40 are provided to the bottoms of side portions 28. Flanges 40 are spaced from top and front portions 18 and 22 at a distance adequate to permit the snug passage of faucet 14. Like portions 18, 22 and 28, flanges 40 are hollow, serving to store a liquid 42, such as a skin softener or bubble-forming soap, admitted into reservoir 27 through inlet opening 16.

Inlet opening 16 is circular in shape and retains a cap assembly 44. As shown, assembly 44 has a mounting ring 46 whose periphery is cemented to top portion 18 within inlet opening 16. Extending from ring 46 is a flexible strap 48 at the end of which cap 24 is integrally formed. Cap 24 seats snugly within the central orifice 50 of ring 46. and includes an vacuum relief vent 45 in its center. A resilient flap 55 partially attached to the bottom of cap 24 normally closes the vent 45. Should a vacuum be generated within body 12, flap 55 will move to the broken line position shown in FIG. 4 as air flows into body 12 through vent 45. Thus, vent 45 prevents the collapse of portions 18, 22 and 28 as liquid 42 is dispensed from body 12.

Valve 26 includes a rigid, valve body 57 affixed within outlet opening 20. Valve body 57 has an inlet port 59 in its top that is in fluid communication with the interior of body 12 and an outlet port 61 in its bottom in fluid communication with the atmosphere. A compressed spring 63 whose bottom end bears against the bottom of valve body 57 urges a ball 65 into inlet port 59 to prevent liquid 42, under the influence of gravity, from leaking through valve 26. When body 12 is squeezed, however, placing liquid 42 under a slight pressure, spring 63 will allow ball 65 to unseat from inlet port 59 to permit liquid 42 to flow through valve 26 and from outlet port 61. Thus, a user can control the flow of liquid 42 from faucet cover and dispenser 10.

Use of faucet cover and dispenser 10 is straightforward. First, side portions 28 are splayed apart and body 12 is positioned over faucet 14 as shown in FIG. 4. Next, cap 24 is disengaged from ring 46 and a chosen liquid 42, perhaps. one capable of producing a bubble bath, is poured through inlet opening 16 until body 12 is filled. Cap 24 is, then, repositioned in ring 46 to close inlet opening 16. Faucet cover and dispenser 10 is now ready to dispense liquid 42.

At a selected time, water may be caused to run from faucet 14 to fill a bathtub or for some other purpose. By squeezing body 12, liquid 42 will be forced through valve 26 and into the water flow from faucet 14. When squeezing ceases, the flow of liquid 42 from body 12 will also stop. The vacuum created by the discharge of liquid 42 from body 12 is relieved by an inrush of air through vent 45. The resilience of body 12 returns such to its unsqueezed and undeformed shape.

While the invention has been described with a high degree of particularity, it will be appreciated by those skilled in the art that modifications may be made thereto. For example, the rear sides of top and side portions 18 and 28 may be provided with integrally formed suction cups 57 to permit the faucet cover and dispenser 10 to be secured to any smooth surface remote from faucet 14. Furthermore, liquid inlet and outlet openings 16 and 20 could be provided with flow control features and valves other than caps 24 and 26 and, perhaps, in some embodiments of the invention caps and valves would be omitted altogether. Therefore, it is to be understood that the present invention is not limited to the sole embodiment described above, but encompasses any and all embodiments within the scope of the following claims.

We claim:

1. A faucet cover and dispenser, comprising: a resilient body adapted for positioning over the end of a faucet, said resilient body having a liquid reservoir therein, said resilient body also having a faucet-receiving chamber surrounded by said liquid reservoir that terminates at openings in the rear and bottom of said resilient body, the top of said resilient body being provided with a liquid inlet opening in fluid communication with said liquid reservoir and the bottom of said resilient body being provided with a liquid outlet opening in fluid communication with said liquid reservoir.

2. The faucet cover and dispenser according to claim 1 further comprising:

a cap releasably positioned within said liquid inlet opening; and, a valve affixed within said liquid outlet opening.

3. The faucet cover and dispenser of claim 2 wherein said cap further includes a vacuum relief vent therein and a resilient flap for selectively closing said vacuum relief vent.

4. The faucet cover and dispenser of claim 2 wherein said valve includes:

a valve body having an inlet port in its top in fluid communication with said liquid reservoir and an outlet port in its bottom in fluid communication with the atmosphere;

a ball positioned within said valve body and sized to close said inlet port; and, a compressed spring positioned within said valve body urging said ball into said inlet port for preventing a liquid from flowing through said inlet port under the influence of gravity.

5. The faucet cover and dispenser according to claim 1 further comprising a plurality of suction cups on the rear of said resilient body for releasable attachment to a smooth surface.

6. A faucet cover and dispenser, comprising: a resilient body formed of rubber and adapted for positioning over the end of a faucet, said resilient body having a pair of opposed side portions having upper and front ends, said upper ends being connected by a top portion, said front ends being connected by a front portion, each of said side, top and front portions being hollow and being in fluid communication with one another so as to form a liquid reservoir, said side, top and front portions being disposed so as to form a faucet-receiving chamber having access openings in the rear and bottom of said resilient body, said top portion being provided with a liquid inlet opening in fluid communication with said liquid reservoir and said front portion being provided with a liquid outlet opening in fluid communication with said liquid reservoir.

7. The faucet cover and dispenser according to claim 6 further comprising a pair of flanges integrally formed said side portions projecting into the bottom of said faucet-receiving chamber, said flanges being hollow and being in fluid communication with said liquid reservoir.

8. The faucet cover and dispenser according to claim 6 wherein said top portion has a recess in communication with said faucet-receiving chamber for receiving therein a valve plunger extending upwardly from a faucet.

9. The faucet cover and dispenser according to claim 6 further comprising:

a cap releasably positioned within said liquid inlet opening; and, a valve affixed within said liquid outlet opening.

10. The faucet cover and dispenser of claim 9 wherein said cap further includes a vacuum relief vent therein and a resilient flap for selectively closing said vacuum relief vent.

11. The faucet cover and dispenser of claim 10 wherein said valve includes:

a valve body having an inlet port in its top in fluid communication with said liquid reservoir and an outlet port in its bottom in fluid communication with the atmosphere;

a ball positioned within said valve body and sized to close said inlet port; and, a compressed spring positioned within said valve body urging said ball into said inlet port for preventing a liquid from flowing through said inlet port under the influence of gravity.

12. The faucet cover and dispenser according to claim 6 further comprising a plurality of suction cups on the rear of said resilient body for releasable attachment to a smooth surface.

13. A faucet cover and dispenser, comprising: a resilient body formed of rubber and adapted for positioning over the end of a faucet, said resilient body having a pair of opposed side portions with upper, lower and front ends, said upper ends being connected by a top portion, said front ends being connected by a front portion, said side portions including at said lower ends thereof, and spaced from said front ends, a pair of inwardly-directed flanges, each of said side, top and front portions and each of said flanges being hollow and being in fluid communication with one another so as to form a liquid reservoir therein, said side portions, top portion, front portion and flanges being disposed so as to define a faucet-receiving chamber having access openings in said resilient body, said top portion being provided with a liquid inlet opening in fluid communication with said liquid reservoir and said front portion being provided with a liquid outlet opening in fluid communication with said liquid reservoir.

14. The faucet cover and dispenser according to claim 13 wherein said front and side portions have a continuous groove opening into said faucet-receiving chamber for accommodating a faucet.

15. The faucet cover and dispenser according to claim 13 further comprising:

a cap releasably positioned within said liquid inlet opening; and, a valve affixed within said liquid outlet opening.

16. The faucet cover and dispenser of claim 15 wherein said cap further includes a vacuum relief vent therein and a resilient flap for selectively closing said vacuum relief vent.

17. The faucet cover and dispenser of claim 15 wherein said valve includes:

a valve body having an inlet port in its top in fluid communication with said liquid reservoir and an outlet port in its bottom in fluid communication with the atmosphere;

a ball positioned within said valve body and sized to close said inlet port; and, a compressed spring positioned within said valve body urging said ball into said inlet port for preventing a liquid from flowing through said inlet port under the influence of gravity.

18. The faucet cover and dispenser according to claim 13 further comprising a plurality of suction cups on the rear of said resilient body for releasable attachment to a smooth surface.

* * * * *